United States Patent [19]

Krueckel et al.

[11] Patent Number: 4,810,124

[45] Date of Patent: Mar. 7, 1989

[54] APPLICATOR DEVICE

[75] Inventors: Peter Krueckel, Heroldsberg; Georg Roeder, Schwabach; Gerhard Moeck, Kirchenehrenbach, all of Fed. Rep. of Germany

[73] Assignee: Schwan-Stabilo Schwanhausser GmbH & Co., Nuremberg, Fed. Rep. of Germany

[21] Appl. No.: 123,766

[22] Filed: Nov. 23, 1987

[30] Foreign Application Priority Data

Dec. 4, 1986 [DE] Fed. Rep. of Germany ..... 3641392

[51] Int. Cl.[4] ..... A46B 11/02

[52] U.S. Cl. ..... 401/149; 401/146; 401/150; 401/270; 401/279

[58] Field of Search ..... 401/146, 149, 150, 151, 401/278, 279, 270

[56] References Cited

U.S. PATENT DOCUMENTS

| | | | |
|---|---|---|---|
| 1,004,936 | 10/1911 | Terzian et al. | 401/279 |
| 1,376,702 | 5/1921 | Kellogg | 401/279 |
| 1,700,807 | 2/1929 | Newton | 401/150 X |
| 2,417,370 | 3/1947 | Magann et al. | 401/279 |
| 2,642,607 | 6/1953 | Bozzalla | 401/150 |
| 3,603,694 | 9/1971 | Hamm | 401/150 |
| 3,892,495 | 7/1975 | Naruse et al. | 401/65 |
| 4,640,638 | 2/1987 | Bokmiller et al. | 410/146 X |

FOREIGN PATENT DOCUMENTS

| | | | |
|---|---|---|---|
| 1302372 | 6/1978 | Fed. Rep. of Germany . | |
| 8515618 | 7/1985 | Fed. Rep. of Germany . | |
| 122784 | 2/1919 | United Kingdom | 401/279 |
| 480873 | 3/1938 | United Kingdom | 401/150 |
| 531741 | 1/1941 | United Kingdom . | |

*Primary Examiner*—Steven A. Bratlie
*Attorney, Agent, or Firm*—Bachman & LaPointe

[57] ABSTRACT

An applicator device for nail-varnish has a dosing pump device operating in the axial direction, which cooperates with an actuating element which can be actuated transversely to the axis.

7 Claims, 2 Drawing Sheets

APPLICATOR DEVICE

FIELD OF THE INVENTION

The present invention concerns an applicator device with (a) a case with an elongate container filled with a viscous mass, nail-varnish in particular; (b) an applicator element, particularly a pencil brush, for the viscous mass; and (c) a duct for the delivery of the viscous mass from the container to the applicator element, there being a control valve between an outlet opening of the container and an inlet opening of the duct which can be actuated by means of an actuating element which is both near the applicator element and displaceable transversely to the axis of the applicator element.

PRIOR ART

Such an applicator device is known, for example, from British Patent Specification No. GB-A-531 741. In that applicator device, the valve is a piston displaceable transversely to the axis of the applicator element in a cylindrical space by means of the push button. The piston has a port which can, when desired, be aligned with the inlet and outlet openings disposed axially to each other. The inlet and outlet openings are thus either simultaneously open or closed. As long as the opening are open, the contents of the container can emerge. In this applicator device the quantity delivered to the applicator element depends, on the one hand, on the respective pressure in the container and, on the other hand, on the time during which the push button-actuated control valve is opened. In practice, the actuation period of the push button does vary, so that different quantities are delivered to the applicator element from one actuation to another. But the applicator element should always receive the same quantity per actuation, not too little, in order to utilize the capacity of the applicator element to he full extent, and not too much, in order to avoid dripping from the applicator element.

German Patent Specification No. DE-B-13 02 372 discloses a dosing pump device (a thrust piston pump) having a pumping element displaceable in the axial direction between an inlet opening and an outlet opening, which can be actuated by means of an axial pusher in which a delivery duct extends. Such dosing pump devices are, for example, mounted on medicine bottles for spraying the substance contained therein. But such a dosing pump device could only be installed into the applicator device of the kind cited at the outset above in such a way that the pumping element is displaceable in the axial direction of the applicator device, since the inlet and outlet openings of the dosing pump device must be arranged behind each other in the longitudinal direction of the container. However, the operation of an actuating element of a dosing pump device in the axial direction is very inconvenient in the case of an applicator device for nail varnish, which must be held in the hand like a writing implement. An actuation of the dosing pump device by depression of the applicator element is precluded a priori, because of the risk of damaging the applicator element related thereto.

German Utility Model Specification No. 85 15 618 describes an applicator device for the application of pastes, where the applicator device has a case with a supply reservoir for receiving the paste, and a propellant gas vessel is arranged behind the supply reservoir to push the paste out of the supply reservoir. The propellant gas vessel has an axially displaceable control valve which can be actuated by means of a push button displaceable transversely to the axis of the applicator element. Such a push button cooperates via ramps with the axially displaceable valve. Apart from the fact that the use of propellant gases is detrimental to the environment, the power requirement for actuating the push button is relatively high because its displacement path must be relatively short so as not to project too far from the applicator device and because there is a relatively high level of friction between the ramps. The short displacement path here has the consequence that the delivery of the paste cannot be accurately dosed.

OBJECT OF THE INVENTION

Now it is the main object of the present invention to provide an applicator device of the kind mentioned at the outset, which is capable, with straightforward handling, of delivering defined quantities of a viscous mass in accurate doses.

SUMMARY OF THE INVENTION

Accordingly the present invention provides an applicator device comprising: a case; an elongate container to be filled with a viscous mass such as nail-varnish; an applicator element for such a viscous mass; a duct for the delivery of such a viscous mass from the container to the applicator element; a control valve between an outlet opening of the container and an inlet opening of the duct and actuatable by means of an actuating element provided near the applicator element and which is displaceable transversely to the axis of the applicator element; wherein the control valve is integrated in a dosing pump device which has an inlet opening connected to the outlet opening of the container, an outlet opening connected to the inlet opening of the duct, and a pumping element which is displaceable between the inlet opening and the outlet opening in the axial direction of the applicator device by means of an axial pusher within which the duct for the delivery of the viscous mass to the applicator element is located; and wherein the actuating element is designed as an L-shaped lever and is hinged on the casing of the applicator device in such a way that when the longer arm of the actuating element is moved transversely to the axis of the applicator device the Pusher is displaced axially by means of the shorter arm to actuate the dosing pump device.

Because of the use of the known dosing pump device in an applicator device of the kind mentioned at the outset above, it is possible to deliver defined quantities to the applicator device. A single complete depression of the applicator element delivers a determined quantity of a viscous mass, nail-varnish for instance, which is just large enough to be sufficient for painting one nail. The operation is very simple and convenient, since the applicator device can be held in the hand like a writing implement and since the applicator element can be easily and accurately operated by means of the thumb. In comparison with a push button which cooperates with the pusher by means of ramps, the L-shaped lever of the invention has the advantage that because of the long lever path, the actuating force is small. The long lever path also provides a good dosing facility, since a substantially longer actuation path of the applicator element is required for a small displacement of the pusher and hence for a small opening of the control valve. The applicator element can, for instance, be depressed only halfway The fulcrum of the L-shaped applicator element is suitably located at the free end of the short arm. This entails a longer lever path than would be the case if the fulcrum were to be located at the junction point between the short and long arms of the L-shaped lever.

Preferably the long arm of the L-shaped actuating element is laterally provided with wings which encompass the case of the applicator device. On the one hand these wings assist the guidance of the applicator element, and on the other hand, they provide protection against the penetration of dirt into the space between the long arm of the actuating element and the case of the applicator device. They also give the applicator device a more pleasing appearance.

Provision can be made, on the inner side of the wings, for one or several bosses which cooperate with a corresponding recess in the case of the applicator device. Such a design gives the user of a nail-varnish applicator device a feeling for the extent to which the applicator element is being actuated and thus facilitates the dosing. Above all such a feature should be used in the fully depressed position of the actuating element, that is to say, one boss on the inner side of the wing should elastically engage in a recess in the casing of the applicator device so that the user knows clearly whether or not she has already fully actuated the dosing pump device. The engagement of the boss in the recess can therewith be combined with the production of a sound to produce a "click effect".

Preferably the short arm of the actuating element encompasses the pusher on both sides and bears on radially projecting studs of the pusher. This design ensures the equilibrium of the forces and thus achieves good stability and is distinguished by its robust nature. When the long arm of the actuating element is pressed, the radial studs of the pusher are loaded via the fork-shaped short arm and the pusher is displaced therewith.

It is, moreover, preferable for the short arm of the actuating element, for example in an annular design, to embrace the pusher from below and to have an engagement element at its embracing part which cooperates with a conjugate engagement element. Thus the pusher is stopped in the axial direction, for instance to prevent an actuation of the dosing pump device via the pusher by an inadvertent pushing back of the applicator element when the actuation via the actuating element is intended.

To stop the actuating element in it unloaded position, when a cover cap is mounted on the applicator device for the protection of the applicator element, the long arm can, moreover, advantageously have an extension at the junction point between the short and long arms of the L-shaped actuating element; this long arm engages conjugately in a slot of the cover cap in order to prevent in such a case an unintentional feeding of the applicator element with the viscous mass.

BRIEF DESCRIPTION OF THE DRAWINGS

Further objects and advantages of the invention follow from the following description of a preferred embodiment, given with reference to the accompanying drawings, in which.

DETAILED DESCRIPTION OF THE PREFERRED EMBODIMENT

Figure 1:
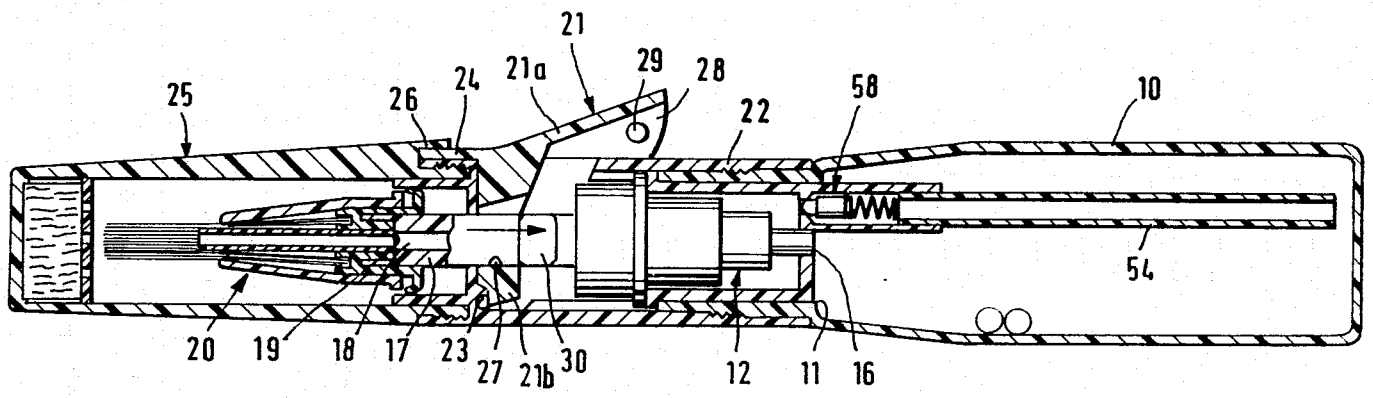
FIG. 1 is a longitudinal cross-section of an applicator device in accordance with the invention.

The applicator device for nail-varnish has a tubular container 10 in whose outlet opening 11, there is inserted a dosing pump device 12. The inlet opening of the dosing pump device is at 16. The pumping element, which is not represented in detail in FIG. 1, is axially displaceable relative to the applicator device and is actuated by a pusher 17 within which there extends a duct 18 leading to an applicator element 20 (in this case a pencil brush) which communicates with the outlet opening 19 of the dosing pump device 12.

The pusher 17 can be axially displaced to actuate the pumping element. It is displaced by means of an L-shaped actuating element 21, which is hinged to one end of the case 22 of the applicator device; the container 10 is screwed into the other of the case 22 as shown.

As is clearly shown in FIG. 1, the fulcrum 23 of the L-shaped lever is located at the free end of the short arm **21*b* which is annular so that the pusher 17 can pass through it. In the rest position of the L-shaped actuating element 21, in contrast to the short arm 21*b* extending perpendicular to the axial direction of the applicator device, the long arm 21*a* of the L-shaped actuating element 21 extends only with a slight slant to the axis of the applicator device and has, at the junction point with the short arm 21*b*, an extension 24 which, in the rest position of the actuating element 21 and when the cover cap 25 is mounted, engages in a slot 26 of the cover cap so that the actuating element 21 is stopped. Provision can be made for a further stop at the part of the short arm 21*b* embracing the pusher 17 from below, for instance in the form of an engagement recess in the pusher 17, cooperating with an engagement projection on that part of the short arm 21*b* embracing the pusher 17 from below as shown. This engagement arrangement 27 ensures that, in the rest position of the actuating element 21, the pusher 17 is still axially locked when the cover cap 25 has been unscrewed, so that the dosing pump device 12 cannot then be actuated by an inadvertent depression of the applicator element 20. This stop arrangement is automatically released as the actuating element 21 is depressed so that the dosing pump device 12** can now be actuated.

The long arm **21*a* of the actuating element 21 has, on both sides, wings 28 encompassing the case 22 of the applicator device so as largely to prevent penetration of dirt into the space between the long arm 21*a* and the case 22 of the applicator device; the wings also improve the visual appearance. On the inner side of one wing, or on the inner side of both wings, one or several bosses 29 may be provided which cooperate with a recess, not represented in detail, on the external side of the case 22** and which indicate the extent to which the actuating element has already been depressed, by means of the sense of touch. However at least one boss should be provided in order to indicate the full actuation of the actuating element and hence of the dosing pump device. In this case, it is also appropriate to design the boss and recess in such a way that one also obtains an audible "click effect".

Plastic material is the preferred material for the construction of the applicator device, since it is sufficiently elastic when required. The fulcrum 23 may for instance be only a thickening at the short arm **21*b* of the actuating element 21, to engage in a corresponding recess in the case 22** of the applicator device.

Figure 2:
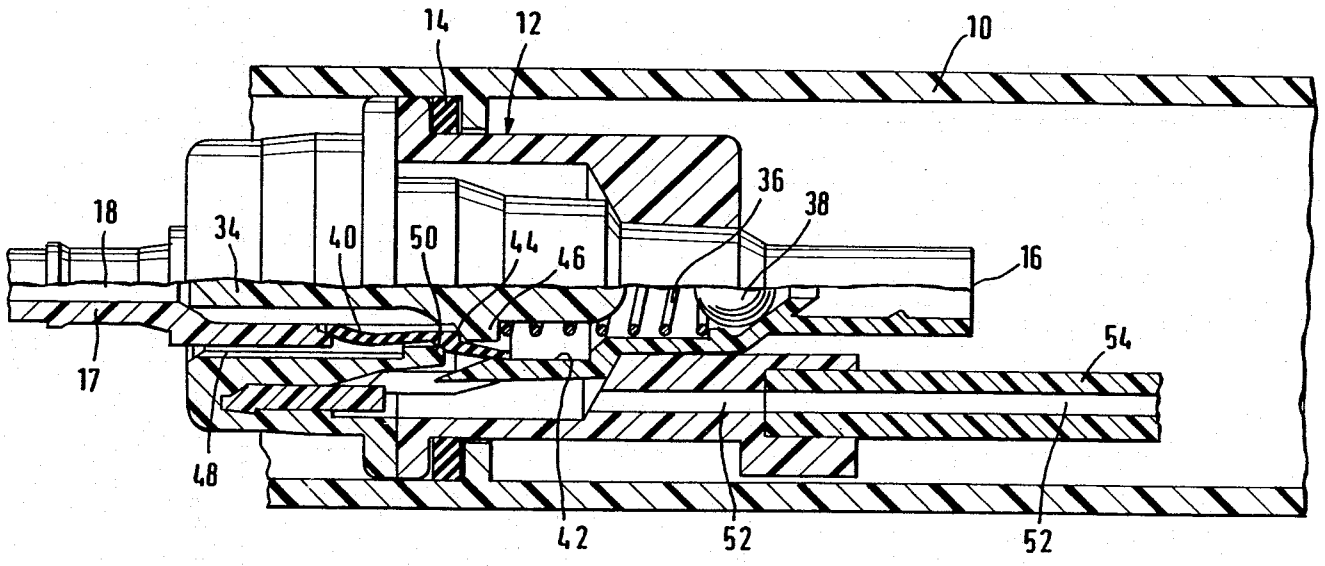
FIG. 2 is an enlarged view, partly in cross-section, of the dosing pump device of the applicator device of FIG. 1.

The dosing pump device shown in FIG. 2 has a piston 34 acted on by the pusher 17, which piston is supported at its end remote from the pusher 17 by a spring 36 thrusting the piston 34 against the pusher 17. At this end of the dosing pump device, near the inlet opening 16, there may be a non-return valve 38 in the form of a ball valve. As shown in FIG. 2, the piston 34 is surrounded by an elastic sleeve 40 which is also supported on the pusher 17 and which bears on the inner wall 42 of a cylindrical space for the piston 34 at the opposite end to the pusher 17.

In the rest position, shown in FIG. 2, the sleeve moreover bears, between the end supported on the pusher 17 and the end touching the inner wall 42 of the cylindrical space, at 44 on a collar 46 surrounding the piston. The seating 44 constitutes the control valve controlling the delivery of the nail-varnish from the container 10 to the applicator element 20. The nail-varnish flows via the inlet opening 16, passes through the non-return valve 38, flows between the piston 34 and the inner wall 42 of the cylindrical space, passes the seating 44 if the sleeve 40 is at a distance from the collar 46, and then flows between the body of the piston 34 and the sleeve 40 into the pusher 17 which encompasses the piston 34 in the manner of a bell, and issues into the duct 18.

Now if the pusher 17 in FIG. 2 is pushed towards the right, the piston 34 as well as the sleeve 40 are therewith also pushed towards the right against the force o the spring 36, and the liquid between the non-return valve 38 and the seating 44 is thus compressed. In this process, the non-return valve 38 is automatically in the closed position. After a certain degree of compression of the liquid, the elastic sleeve 40 separates from the collar 46, that is to say the control valve automatically opens and the compressed liquid can pass into the delivery duct 18. Therewith, a preset quantity of liquid is delivered at a preset pressure and after delivery of this preset quantity, the control valve again automatically closes and the spring 36 biases the piston 34 with the sleeve 40 and the pusher 17 back into the initial position.

Now, as more liquid is taken from the container 10, the pressure in the container 10 is further reduced so that finally the external pressure is so high that no more liquid can be extracted, unless provision is made for special pressure equalization measures. In the case in point, these are formed by a pressure equalization vent 48 located between the pusher 17 and the case of the dosing pump device 12 and controlled by the same control valve which also controls the delivery of the liquid to the applicator element. As shown in FIG. 2, in the rest position the sleeve 40 bears not only on the collar 44 of the piston 34, but, also, on the opposite side, against the case of the dosing pump device. Thus, in the rest position, that is to say when the applicator device is not being used, the pressure equalization vent 48 is closed. Now i, in FIG. 2, the piston 34 is pushed towards the right in order to compress the liquid between the non-return valve 38 and the seating 44, the control valve advantageously first opens the pressure equalization vent 48 before the sleeve 40 separates from the collar 46 and hence frees the delivery of the liquid to the applicator element. Thus the pressure equalization is effected beforehand. The region at which the passage opening 48 is closed or opened is designated as 50.

From the valve region 50, the air flowing in from the outside then passes into a ventilation duct 52 which starts in the casing of the dosing pump device and then continues as the tubelet 54 whose end is closed by a non-return valve 58, as shown in FIG. 1. This non-return valve 58 prevents any application liquid from passing to the pressure equalization vent 48 or to the ventilation region 50 and there drying out to block ventilation, in the case of excess pressure in the container which can for instance arise by the heating of the applicator device in the sun.

An isolating pump device as used in the present application is described in said German Patent Specification No. DE-B-1 302 372.

As may moreover be seen in FIG. 1, the pusher 17 has on its opposite sides radial studs 30 which cooperate with the lateral parts of the short arm 21*b* encompassing the pusher 17 to displace the pusher against the elastic force of the dosing pump device 12.

We claim:

1. In an applicator for nail-varnish:

(a) a hand-held unit including a casing and an elongate container substantially rigidly connected to each other;

(b) said elongate container filled with nail-varnish and having an outlet opening;

(c) an applicator element for applying said nail-varnish;

(d) a duct connecting the container and applicator element for the delivery of said nail-varnish from the container to the applicator element, said duct having inlet and outlet openings;

(e) a control valve located between said outlet opening of the container and said inlet opening of the duct; and (f) an actuating element provided near the applicator element and displaceable transversely to the axis of the applicator element for actuating said control valve;

the improvement wherein:

(g) a dosing pump device having an inlet opening connected to said outlet opening of the container and an outlet opening connected to said inlet opening of the duct, said control valve being integrated in said dosing pump device;

(h) said dosing pump device further having a pumping element displaceable between said inlet and outlet openings of the dosing pump device in the axial direction of the applicator device;

(i) said dosing pump device further including an axial pusher within which said duct for the delivery of the nail-varnish to the applicator element is located;

(j) said actuating element is designated as an L-shaped lever having a longer arm and a shorter arm, including lateral wings to the longer arm of L-shaped actuating element, said lateral wings encompassing the casing of the applicator device; and (k) hinge means mount the actuating element pivotably on the casing of the applicator device such that when the longer arm of the actuating element is moved transversely to axis of the applicator device the axial pusher is displaced axially by means of the shorter arm to actuate the dosing pump device.

2. An applicator device according to claim 1, wherein the L-shaped actuating element has fulcrum means located at the free end of said shorter arm.

3. An applicator device according to claim 1, including at least one boss on the inner side of at least one of said wings, and a corresponding recess means in the casing of the applicator device for cooperating with said at least one boss.

4. An applicator device according to claim 1, wherein the shorter arm of the actuating element encompasses the pusher on both sides and wherein the pusher has radially projecting studs engaging said encompassing shorter arm.

5. An applicator device according to claim 1, wherein the shorter arm of the actuating element embraces the pusher underneath and on the side thereof remote from the longer arm, said shorter arm has an engagement element on its embracing part, and said axial pusher has a conjugate engagement element cooperating with said engagement element of the shorter arm.

6. An applicator device according to claim 1, including a protective cover cap of the applicator device mounted on the applicator device, said cover cap including slot means, and wherein said longer arm has an extension which starts from the junction point between the shorter and the longer arms of the L-shaped actuating element.

7. An applicator device according to claim 1, wherein said applicator element is a pencil brush.

* * * * *